US006908074B2

(12) United States Patent
Eiwan

(10) Patent No.: US 6,908,074 B2
(45) Date of Patent: Jun. 21, 2005

(54) DEVICE FOR CHANGING THE RIGGING OF THE PULLEY BLOCKS OF A CRANE

(75) Inventor: Christoph Eiwan, Grafrath (DE)

(73) Assignee: Potain, Ecully (FR)

( * ) Notice: Subject to any disclaimer, the term of this patent is extended or adjusted under 35 U.S.C. 154(b) by 98 days.

(21) Appl. No.: 10/425,890

(22) Filed: Apr. 30, 2003

(65) Prior Publication Data

US 2003/0227186 A1 Dec. 11, 2003

(30) Foreign Application Priority Data

Jun. 4, 2002 (FR) ..... 02 06869

(51) Int. Cl.[7] ..... B66D 3/04
(52) U.S. Cl. ..... 254/390; 254/393
(58) Field of Search ..... 254/390, 393, 254/396, 397, 398, 403, 409

(56) References Cited

U.S. PATENT DOCUMENTS

| | | | | |
|---|---|---|---|---|
| 1,436,608 A | | 11/1922 | Rodier | |
| 2,353,479 A | | 7/1944 | Lock | |
| 3,648,979 A | | 3/1972 | Ratcliff | |
| 4,098,492 A | | 7/1978 | Wilkinson | |
| 4,170,308 A | * | 10/1979 | Rogers | 212/281 |
| 5,426,907 A | * | 6/1995 | Franklin | 52/749.1 |
| 5,451,032 A | * | 9/1995 | Rhoads | 254/399 |
| 5,476,247 A | * | 12/1995 | Melder | 254/404 |
| 6,021,910 A | * | 2/2000 | Franklin | 212/270 |
| 6,592,101 B2 | * | 7/2003 | Vetesnik | 254/285 |
| 6,595,494 B1 | * | 7/2003 | Roodenburg et al. | 254/277 |
| 6,601,829 B2 | * | 8/2003 | Graham | 254/391 |
| 6,742,770 B1 | * | 6/2004 | Vassioukevitch | 254/391 |

FOREIGN PATENT DOCUMENTS

DE 40 22 275 A1 2/1991

* cited by examiner

*Primary Examiner*—Emmanuel Marcelo
(74) *Attorney, Agent, or Firm*—Oliff & Berridge, PLC

(57) ABSTRACT

The device enables a switch from the pulley blocks being rigged with one strand to the pulley blocks being rigged with two strands and vice versa. The jib tip has a pulley moveable along its axle between a central position, when the blocks are rigged with one strand, and a lateral position, when the blocks are rigged with two strands. The lifting block, with housing of symmetric shape, comprises a pulley and retractable guide means for the lifting cable. When the blocks are rigged for two strands, the end of the cable is connected to a point of attachment situated on the jib tip, on the opposite side to the lateral position of the pulley. When the blocks are rigged with one strand, the end of the cable is connected to a point of attachment situated on the pulley block. This device for changing the rigging of the blocks applies mainly to luffing cranes.

13 Claims, 4 Drawing Sheets

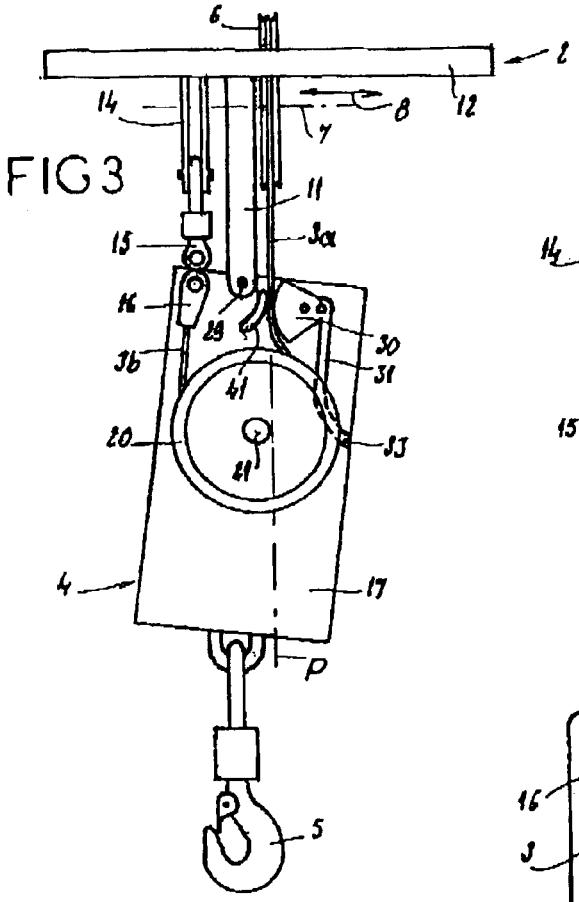
FIG 3
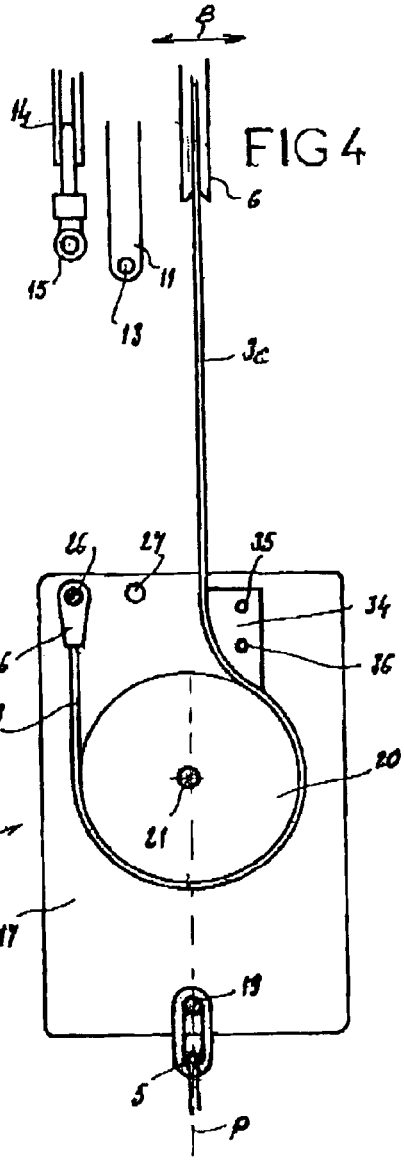
FIG 4
FIG 5
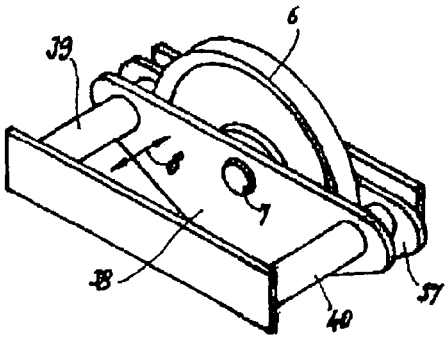

DEVICE FOR CHANGING THE RIGGING OF THE PULLEY BLOCKS OF A CRANE

BACKGROUND OF THE INVENTION

The present invention relates to a device for changing the rigging of the pulley blocks of a crane, particularly for a luffing crane, this device enabling the rigging of the lifting cable to be changed between an arrangement rigged with one strand and an arrangement rigged with two strands, and vice versa, without removing the pulley block.

DESCRIPTION OF THE PRIOR ART

In a luffing crane, the lifting cable passes over one or more pulleys borne by the jib tip, the pulley block equipped with a lifting hook being suspended, via the lifting cable, under the jib tip. The number of vertical strands formed by the lifting cable, between the jib tin and the pulley block, determines the "rigging" or "sheaving". This number of strands can be made variable using a device for changing the rigging of the blocks so as to adapt the crane to suit various conditions in which the crane is used. In particular, the rigging of the strands determines the lifting rate, a pulley block rigged with a single strand being suited for rapid lifting, for a relatively light load, whereas blocks rigged with two strands are suitable for lifting heavier loads at a slower speed.

One known device for changing the rigging of the blocks of such a crane, allowing the change from a one-strand pulley block arrangement to a two-strand pulley block arrangement and vice versa is essentially characterized by:

- a jib tip structure with a cable route passing in succession over two pulleys situated in the vertical midplane of the jib and also comprising a fixed point situated in the longitudinal axis of the jib;
- a pulley block situated in, the vertical midplane of the jib, this pulley block having a particular shape allowing for the distribution of mass, when the crane is in the work position using one strand, so that the lifting hook lies in the vertical axis of the single strand of cable.

This technical solution has various disadvantages:

The jib tip needs to he of a special design, in the form of a box section mouth, to take the width of the pulley block, and also requires, the cable to pass on the outside of the jib, with two pulleys. In addition, the structure of the jib tip needs to be significant, in order to react to the bending forces due to the mouth shape of the end of the jib tip. The result of this, as far as the jib tip is concerned, is that it is very complex to produce and very weighty, this itself requiring a jib tie attachment situated further forward.

As to the lifting block, this has an asymmetric shape and this may lead to undesirable rotation of this block if the wind blows. Furthermore, the block has legs for setting it down on the ground on one side, when the block is rigged with one strand, entailing manual guidance of the block when it is being set down on the ground for maintenance.

The present invention also sets out to avoid all the aforesaid disadvantages while at the same time providing a simpler and more economical solution to changing the rigging of the blocks, which solution in particular:

- eliminates any special structure for the jib tip, and requires just one pulley on the jib tip, hence affording considerable simplification;
- thus allows the jib tip to have a more lightweight construction, for the same load/span characteristics;

- also leads to a simpler, more lightweight and better balanced design of pulley block, which, in particular, will be balanced, without special arrangements, in the one-strand work position.

SUMMARY OF THE INVENTION

To this end, the subject of the present invention is a device for changing the rigging of the blocks of a crane, of the type specified in the introduction, and which essentially comprises, in combination:

- on the jib tip, a single pulley mounted on a horizontal axle oriented transversely to the jib along this axle, the pulley being moveable between a central position, situated more or less in the vertical midplane of the jib, for the rigging arrangement with one strand, and a lateral position for the rigging arrangement with two strands, the jib tip also comprising, for the rigging arrangement with two strands, a point of attachment of the end of the lifting cable, this point of attachment being situated, with respect to the vertical midplane of the jib, on the opposite side to the lateral position of the pulley;
- a lifting block with housing of symmetric overall shape, housing a pulley of horizontal axis, the block being equipped with means of attachment of the end of the lifting cable, for the rigging arrangement with one strand, and also with guide means for the lifting cable, guiding this cable toward the center of the upper part of the housing of the block, for the rigging arrangement with one strand, the arrangement being such that in the rigging arrangement with two strands, the block is situated more or less in a vertical plane perpendicular to the vertical midplane of the jib.

Thus, the principle of the invention is as follows:

- when the blocks are rigged with one strand, the single pulley of the jib tip is kept in the vertical midplane of the jib. The end of the lifting cable is attached to the pulley block, and guided over this pulley block in such a way that the block is suspended symmetrically and in equilibrium from the lifting cable, the lifting hook lying in the vertical midplane of the jib.
- when the block is rigged with two strands, the pulley of the jib tip is laterally offset and the end of the lifting cable is attached to the jib tip on the opposite side to the pulley (with respect to the vertical midplane of the jib). Thus, the two strands of the lifting cable, and the pulley block itself, lie more or less in a vertical plane perpendicular to the vertical midplane of the jib.

As a preference, the lateral offset of the pulley of the jib tip, in the rigging arrangement with two strands is more or less equal to the horizontal distance between the point of attachment provided on the jib tip and the vertical midplane of the jib; hence, in the rigging arrangement with two strands, the lifting hook also lies in the vertical midplane of the jib.

The system for laterally offsetting the single pulley of the jib tip is achieved in various ways.

According to one embodiment, this pulley is mounted in a pulley box, consisting in particular of two vertical plates parallel to the vertical midplane of the jib, said pulley box being mounted to slide on at least two horizontal slideways oriented transversely to the jib, means being provided for immobilizing the pulley box, therefore for positioning the pulley, either in a central position when the blocks are rigged with a single strand, or in a lateral position when the blocks are rigged with two strands.

As an alternative, the pulley of the jib tip is mounted so that it can be moved in translation on a horizontal shaft oriented transversely to the jib, the pulley being placed between two endplates mounted around the aforesaid shaft and designed to be immobilized in terms of translation along this shaft, for example using pins, in chosen axial positions which keep the pulley either in a central position, when rigged with one strand, or in a lateral position, when rigged with two strands.

According to another alternative, the pulley of the jib tip is secured to a horizontal shaft oriented transversely to the jib, the shaft being moveable in translation in its bearings so that the entity consisting of the pulley and its shaft is moveable transversely to switch from the position in which the blocks are rigged with one strand, with the pulley in a central position, to the position in which the blocks are rigged with two strands, with the pulley offset laterally, or vice versa.

According to yet another possibility, equivalent to the preceding solutions, the invention makes provision for the single transversely moveable pulley at the jib tip to be replaced by two coaxial pulleys particularly mounted on one and the same horizontal shaft oriented transversely to the jib, with a first pulley situated in a central position, more or less in the vertical midplane of the jib, for when the blocks are rigged with one strand, and with a second pulley situated in a lateral position, offset from the vertical midplane of the jib, for when the blocks are rigged with two strands, the switch from the blocks being rigged with one strand to the blocks being rigged with two strands, or vice versa, being performed by moving the lifting cable from the first pulley to the second pulley, or vice versa.

Advantageously, the device for changing the rigging of the blocks that is the subject of the present invention further comprises means of temporarily fixing the lifting block under the jib tip. These means can be produced in the form of a single or double lug secured to the framework of the jib tip and pointing downward, said lug being designed to have passing through it, at its lower part, a removable axle for connection with the upper part of the housing of the lifting block, raised into its highest position. These means allow the pulley block to be fixed directly under the jib tip, the latter in particular being brought into horizontal position, so that the operations of changing the rigging of the blocks can be performed; the mechanical connection between the block and the tip of the jib, thus made, allows the end of the lifting cable to be detached from one of its points of attachment (on the jib tip or on the pulley block) and allows this end of the cable to be brought to the other point of attachment, to which it is then fixed.

On the lifting block, the guide means for the lifting cable consist, in one particular embodiment, of a curved guide borne by an arm mounted to pivot in the housing of the block, the guide thus being moveable between an active raised position more or less tangential to the pulley of the block and guiding the cable toward the center of the upper part of the housing of the block, when the blocks are rigged with one strand, and a retracted lowered position when the blocks are rigged with two strands, means being provided for the non-permanent immobilization of said guide in one or other of its two positions.

In an alternative form, the guide means for the lifting cable consist of a shoe sitting inside the housing of the lifting block, above the pulley of the block, the shoe having a curved side guiding the cable, placed on this side, toward the center of the upper part of the housing of the block, means being provided for the non-permanent fixing of said shoe in the housing of the block.

According to another feature, the housing of the lifting block is equipped, at its lower part, with legs so that it can be set down on the ground, particularly for maintenance operations.

Overall, the device for changing the rigging of the blocks of a crane that is the subject of the present invention has the following advantages:

- the jib tip is of a simple design because it requires no special structure and has a single pulley, possibly two pulleys borne by the same shaft.
- As a result, this jib tip is more lightweight, this being for the same load/span characteristics.
- The lifting block can also be produced more simply, particularly with symmetric shapes, and also so that it is more lightweight, without requiring a counterweight to balance it when the block is rigged as a one-strand pulley block.
- This symmetric, and balanced, pulley block is not sensitive to the effects of the wind: any undesirable rotation should the wind blow can be eliminated.
- The legs of the pulley block, for setting it down on the ground, are always directed downward, and this avoids any special guidance for setting it down on the ground, whether this be when it is in use as a one-strand block or as a two-strand block.
- The operations of changing the rigging of the blocks are performed with relative ease "up in the air" without removing the block which, during these operations, is fixed under the jib tip, thus also affording all the desirable safety.
- The maximum span of the crane remains the same when the blocks are rigged as a two-strand pulley block and when they are rigged as a one-strand block, given the transverse position of the pulley block when rigged for two-strand operation, which position makes it possible to keep the same lifting axis as is used when the blocks are rigged as a one-strand block, this axis passing through the end of the jib tip.

BRIEF DESCRIPTION OF THE DRAWINGS

The invention will be better understood with the aid of the description which follows, with reference to the attached schematic diagram which, by way of examples, depicts a few embodiments of this device for changing the rigging of the blocks for a crane:

FIG. 3 is an end-on view of the jib of the crane, the pulley block being in the position for changing the way in which it is rigged;

FIG. 4 is a view comparable with FIG. 3, illustrating an alternative form of pulley block, as regards its means of guidance for the lifting cable;

FIG. 5 is a perspective view of an alternative way of mounting the pulley of the jib tip;

DESCRIPTION OF THE PREFERRED EMBODIMENTS

Figure 1:
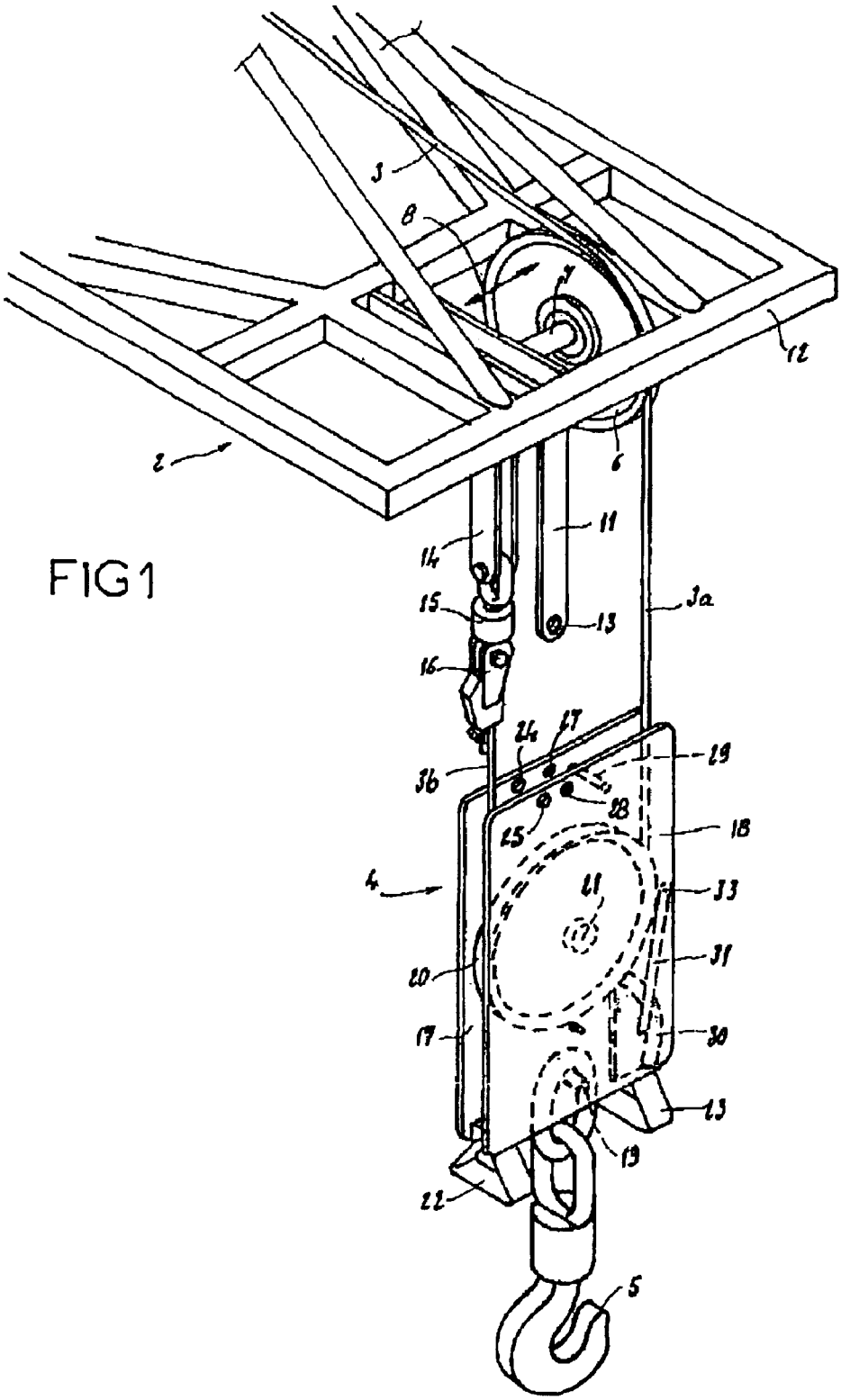
FIG. 1 is a perspective view showing the end of the jib of a crane, equipped with the device that is the subject of the invention, in the position in which the blocks are rigged for two-strand operation.
Figure 2:
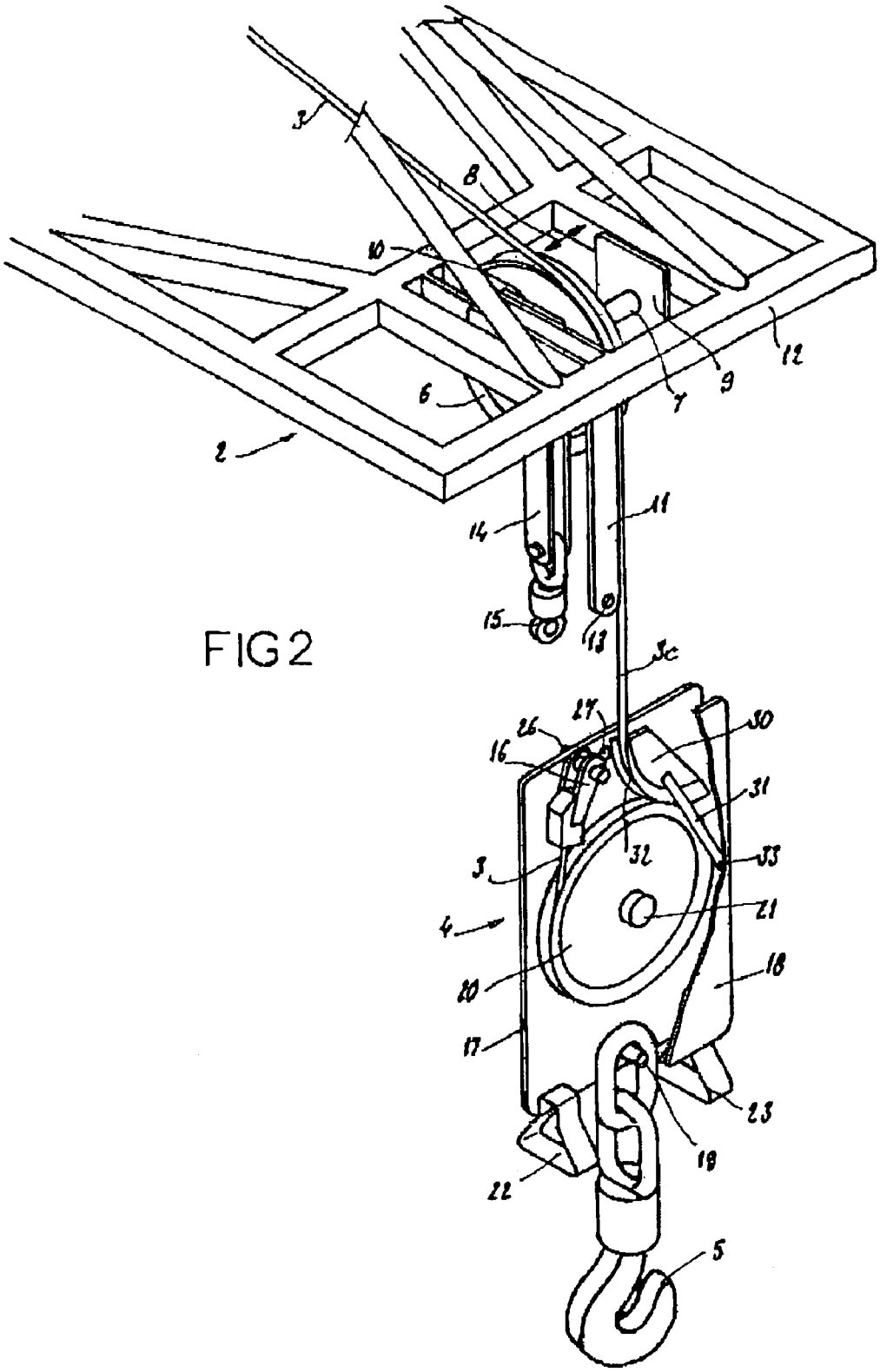
FIG. 2 is a perspective views similar to FIG. 1, but illustrating the position in which the blocks are rigged for one-strand operation.

FIGS. 1 and 2 partially show the jib tip 2 of a luffing crane, the jib here being assumed to be in a horizontal position. These figures also show part of the lifting gear of the crane, comprising a lifting cable 3 and a lifting block 4 which bears a lifting hook 5. The lifting cable 3, operated by a lifting winch, not depicted, can form a lifting block rigged for two strands 3*a* and 3*b* (FIG. 1) or a lifting block rigged for one strand 3*c* (FIG. 2). A device for changing the rigging of the blocks allows the switch from a block rigged with two strands 3*a*, 3*b* to a block rigged with one strand 3*c*, and conversely from a block rigged with one strand 3*c* to a block rigged with two strands 3*a*, 3*b*. This device comprises special arrangements of the jib tip 2 and the lifting block 4.

The jib tip 2 bears a single pulley 6, over which the lifting cable 3 which comes from the rear of the jib runs, the pulley 6 thus deflecting the cable 3 downward, toward the block 4 situated under the jib tip 2. The pulley 6, situated in a vertical plane, is mounted on a horizontal shaft 7 oriented transversely to the jib.

In addition, in the embodiment shown in FIGS. 1 and 2, the pulley 6 can be moved in translation along the horizontal shaft 7, in the direction of the arrow 8.

Two endplates 9 and 10, mounted about the shaft 7, flank the pulley 6. The two endplates 9 and 10 are equipped with pins (not depicted) which allow them to be locked in terms of translation in various positions on the shaft 7.

A downwardly pointing lug 11 is fixed to the framework of the jib tip 2, more specifically to an end crossmember 12 of this framework, situated just forward of the pulley 6. The lug 11 has a hole 13 toward its free lower end.

Also fixed under the crossmember 12 is a yoke 14, at the lower end of which is mounted a shackle 15 acting as a point of attachment for the end of the lifting cable 3, this cable end being provided with a wedging box 16. The yoke 14 with its shackle 15 is situated on the same side as the lug 11, and is thus laterally offset with respect to the vertical midplane P of the jib tip 2 (see also FIGS. 3 and 4).

The lifting block 4 has a housing of symmetrical overall shape, consisting mainly of two parallel plates 17 and 18 joined together, the two plates 17 and 18 being more or less rectangular, and vertical. The lifting hook 5 is attached to a horizontal axle 19 connecting the two plates 17 and 18 in their lower part.

Arranged between the two plates 17 and 18 of the lifting block is a pulley 20 mounted to rotate on a horizontal axle 21 which connects the two plates 17 and 18.

The housing of the lifting block 4 is equipped, at its lower part, with two legs 22 and 23, fixed between the two plates 17 and 18, on each side of the lifting hook 5.

In its upper part, the housing of the lifting block 4 comprises means of attachment for the end of the lifting cable 3. These means here consist of two holes 24 and 25 formed in register with each other in the upper parts ox the two plates 17 and 18 and of an axle 26 which can be engaged removably in the two holes 24, 25 and in the wedging box 16 of the end of the lifting cable 3.

In their upper part, the two plates 17 and 18 further comprise other respective holes 27 and 28 formed in register with each other and designed to take a removable axle 29 intended to connect the lifting block 4 to the lug 11 during the operations of changing the way in which the block is rigged.

Between the two plates 17 and 18, the lifting block 4 is equipped with a curved guide 30, borne by a pivoting arm 31. The curved guide 30 has a groove 32 tailored to the thickness of the lifting cable 3. The pivoting arm 31 is articulated about a horizontal axle 33 situated on one of the vertical sides of the block 4. Thus, the curved guide 30 can be moved, by the pivoting of the arm 31 about the axle 33, between an active raised position more or less tangential to the pulley 20 (see FIGS. 2 and 3) and a retracted lowered position (FIG. 1). Means, of the removable axle or pin type, are provided for non-permanently immobilizing the curved guide 30 in one or other of the two positions mentioned above. Advantageously, the horizontal pivot axle 33 bears, at one of its ends, an external operating rod or handle (not depicted) that can be used to cause the curved guide 30 to move from its active position to its retracted position and vice versa.

In all the configurations in which the blocks are rigged, the lifting cable 3 passes around the lower part of the pulley 20 of the lifting block 4. When the block is rigged with two strands 3*a*, 3*b* (see FIG. 1), the pulley 6 of the jib tip 2 is laterally offset and kept in this offset position on the shaft 7 by the translational immobilization of the two endplates 9 and 10 visible in FIG. 2. The wedging box 16 at the end of the lifting cable 3 is attached to the shackle 15 borne by the yoke 14 at the jib tip 2. The curved guide 30 is placed and immobilized in its retracted lowered position, so that it does not act. The offset position of the pulley 6, at the position of the point of attachment (shackle 15) of the end of the cable 3, are then such that the lifting block 4 is more or less perpendicular to the vertical midplane P of the jib. In other words, the two strands 3*a* and 3*b* formed by the lifting cable lie in one and the same vertical plane perpendicular to the vertical midplane P of the jib. In addition, the lifting axis, that is to say the vertical axis of the hook 5, is contained in the vertical midplane P of the jib. Note too that the transverse vertical plane containing the lifting block 4 passes more or less through the end crossmember 12 of the jib tip 2, which means that the maximum span of the crane is not reduced (for a given jib length).

In a position in which the blocks are rigged with one strand 3*c* (FIG. 2), the pulley 6 of the jib tip 2 is placed in the vertical midplane P of the jib, and is kept in this central position on the shaft 7 by the translational locking of the two endplates 9 and 10. The wedging box 16 at the end of the lifting cable 3 is attached to the lifting block 4, more particularly to the axle 26 engaged in the two holes 24 and 25. In this position, the curved guide 30 occupies its raised active position and is immobilized in this position. Thus, at the point where it moves away from the pulley 20, the single strand 3*c* of the lifting cable 3 is guided toward the center of the upper part of the housing 17, 18 of the pulley block 4. As a result, in the position in which the block is rigged with one strand 3*c*, the lifting block 4 is suspended symmetrically and in equilibrium, the lifting axis here again lying in the vertical midplane P of the jib, and as close as possible to the end (crossmember 12) of the jib tip 2.

Referring also to FIG. 3, we shall now explain the procedure to be followed in order to switch from the position in which the block is rigged with two strands. 3*a*, 3*b* to the position in which it is rigged with one strand 3*c*.

The luffing jib of the crane concerned is first of all brought into a horizontal position. The customary working platform, not depicted, is brought toward the jib tip 2, to allow an operator to act. At the crane controls, the "erection" position is selected so as to disable the crane travel limit stops. The lifting block 4 is then brought into its uppermost position, just under the end crossmember 12 of the jib tip 2, beyond the maximum position to which the upward travel of the lifting hooks 5 is limited.

In this raised position, the pulley block 4 is fixed temporarily under the jib tip 2, by engaging the axle 29 simultaneously in the two holes 27 and 28 in the plates 17 and 18 of the pulley block 4, and in the hole 13 in the lug 11 secured to the end crossmember 12 of the jib tip 2.

The lifting cable 3 is then given some slack and the axle still connecting the wedging box 16 to the shackle 15 is withdrawn. The end of the cable 3 thus becomes free. This end is then attached to the housing 17, 18 of the pulley block 4, by engaging the axle 26 through the two holes 24, 25 and the wedging box 16.

Next, the pulley 6 of the jib tip 2 is unlocked and moved along its shaft 7, to position it in the vertical midplane P of the jib. The pulley 6 is immobilized in this central position.

The curved guide 30 is brought into its active raised position and is locked in this position so as to "center" the lifting cable engaged in its groove 32. Next, the cable 3 is tensioned by action of the lifting winch, until load on the connection between the pulley block 4 and the lug 11 is relieved. This connection is then disconnected, by withdrawing the axle 29.

The working platform is finally retreated and returned to its position of non-use, and the "work" position is selected at the crane controls.

The switch from the position in which the block is rigged with one strand 3*c* to the position in which it is rigged with two strands 3*a*, 3*b* is performed by carrying out the aforementioned operations, but in reverse order, this other change of rigging still being performed by temporarily fixing the lifting block 4 under the jib tip 2.

According to an alternative illustrated in FIG. 3, the lifting block 4 comprises, in its upper part, a stationary mating shape 41 situated facing the active raised position of the curved guide 30. Thus, in the position in which the block is rigged with one strand 3*c*, the lifting cable 3 passes between the curved guide 30 and the mating shape 41, thus guaranteeing that it will be positioned at the center of the upper part of the housing 17, 18 of the pulley block 4.

FIG. 4 shows an alternative form of the lifting block 4, in which the pivoting curved guide already described is replaced with a shoe 34 placed inside the housing of the pulley block 4, that is to say between the two plates 17 and 18, above the pulley 20. The shoe 34 has a curved side which guides the lifting cable 3, placed on this side, toward the center of the upper part of the block 4. This shoe 34 is immobilized in position non-permanently in the housing 17, 18 of the pulley block, for example using two axles 35 and 36.

Another alternative form relating to the way in which the pulley 6 is mounted at the jib tip 2 is illustrated in FIG. 5. The pulley 6 is here mounted to rotate, on an axle 7, in a pulley box consisting of two vertical plates 37 and 38 that are mutually parallel and parallel to the vertical midplane of the jib. The pulley box 37, 38 is mounted to slide in the direction of the arrow 8 on two horizontal slideways 39 and 40 oriented transversely to the jib. Means, not depicted, are provided for immobilizing the pulley box 37, 38 either in a central position, to rig the blocks with one strand, or in a laterally offset position, to rig them with two strands, the structure and operation of the device for changing the way in which the block is rigged being otherwise unchanged.

Figure 6:
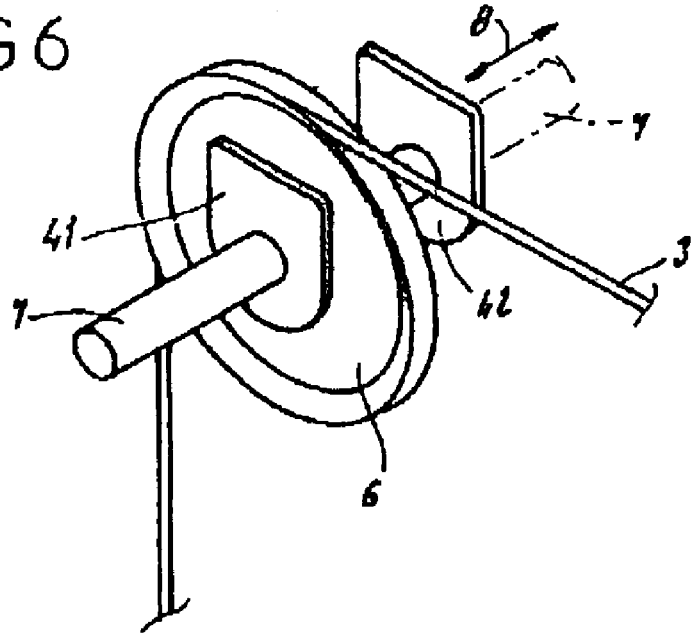
FIG. 6 is a perspective view of another alternative way of mounting this pulley.

FIG. 6 illustrates yet another alternative way of mounting the pulley 6 of the jib tip 2. The pulley 6 here is secured to its horizontal shaft 7, which is mounted both so that it can rotate and so that it can move in terms of translation (arrow 8) in bearings 41 and 42. Thus, in this instance, it is the entity consisting of the pulley 6 and its shaft 7 which is moved transversely, to switch from the position in which the block is rigged with one strand 3*c*, with the pulley 6 in a central position, to the position in which the block is rigged with two strands 3*a*, 3*b*, with the same pulley 6 laterally offset.

Figure 7:
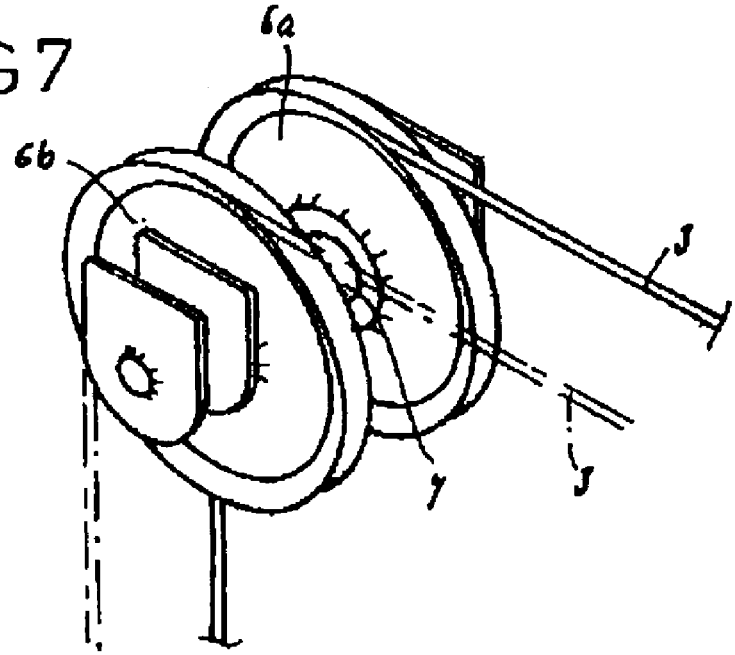
FIG. 7 is a perspective view showing a different arrangement of the pulleys on the jib tip.

Finally, FIG. 7 illustrates an alternative solution in which, on the jib tip 2, the single and transversely mobile pulley 6 of the previous embodiments is replaced by two coaxial pulleys 6*a* and 6*b*, mounted on the same horizontal shaft 7, oriented transversely to the jib. The first pulley 6*a* is situated in a central position, that is to say in the vertical midplane of the jib, and is used when the blocks are rigged as one-strand pulley blocks. The second pulley 6*b* is situated in a lateral position and is therefore offset from the vertical midplane of the jib, and used when the blocks are rigged as two-strand pulley blocks. The switch from one-strand pulley block operation to two-strand pulley block operation, or vice versa, is performed by moving the lifting cable from the pulley 6*a* to the pulley 6*b* or from the pulley 6*b* to the pulley 6*a*. The operation is performed manually, when the pulley block 4 is fixed temporarily under the jib tip 2 (as described above).

The device for changing the rigging of the blocks that is the subject of the invention can be applied in particular to trolleyless luffing cranes, of great height, working at high lifting rates.

The following would not constitute a departure from the scope of the invention as defined in the attached claims:

- if details regarding the shape, such as the shapes of the housing of the lifting block, were modified;
- if the system for laterally offsetting the jib tip pulley were produced in a different way;
- if the pivoting curved guide or the shoe of the lifting block were replaced by any equivalent means of guiding the lifting cable;
- if the lug for temporarily fixing the lifting block under the jib tip were replaced by a short sling.

What is claimed is:

1. A device for changing rigging of pulley blocks of a crane, comprising:

a jib tip of a jib of a crane configured to allow rigging of a pulley block with respect to a lifting cable to be changed at least between a first rigging arrangement with one strand of cable, and a second rigging arrangement with two strands of cable, the jib tip comprising:

a single pulley mounted on a horizontal axle oriented transversely to the jib, the pulley being moveable along the axle between a first position substantially in the vertical midplane of the jib to accommodate the first rigging arrangement and a second position, offset transversely alone the axle from the vertical midplane of the jib, to accommodate the second rigging arrangement, and an attachment point for attaching an end of a lifting cable to the jib tip in the second rigging arrangement, the attachment point situated on the jib tip on an opposite side of the vertical midplane of the jib with respect to the second position of the pulley; and a lifting block, comprising:

a housing which houses a pulley on a horizontal axis to accommodate the second rigging arrangement, and an attachment point for attaching the end of the lifting cable to the lifting block, and a guide for guiding the lifting cable toward the center of the upper part of the housing of the block to accommodate the first rigging arrangement.

2. The device for changing according to claim 1, wherein a distance of the transverse offset of the pulley of the jib tip in the second rigging arrangement is substantially equal to the horizontal distance between the attachment point the jib tip and the vertical midplane of the jib.

3. The device for changing rigging according to claim 1, wherein the pulley of the jib tip is mounted in a pulley box comprising:

two vertical plates substantially parallel to the vertical midplane of the jib, the pulley box being mounted to slide on at least two horizontal slideways oriented transversely to the jib; and an immobilizing device for immobilizing the pulley box to position the pulley in at least one of the first position and the second position.

4. The device for changing rigging according to claim 1, wherein the pulley of the jib tip is mounted so that the pulley can be moved in translation on a horizontal shaft oriented transversely to the jib, the pulley being placed between two endplates mounted around the horizontal shaft, and the pulley can be immobilized in translation along the horizontal shaft, using at least one of pins and other like immobilizing devices, in chosen axial positions to keep the pulley in at least one of the first position and the second position.

5. The device for changing rigging according to claim 1, wherein the pulley of the jib tip is secured to the horizontal shaft as a single unit, the shaft being moveable in translation in shaft bearings so that the single unit is moveable transversely so that the pulley can be moved between the first position and the second position.

6. A device for changing rigging of pulley blocks of a crane, comprising:

a jib tip of a jib of a crane configured to allow rigging of a pulley block with respect to a lifting cable to be changed at least between a first rigging arrangement with one strand of cable, and a second rigging arrangement with two strands of cable, the jib tip comprising:

two coaxial pulleys mounted on a single horizontal shaft oriented transversely to the jib, a first of the two coaxial pulleys situated in a first position substantially in a vertical midplane of the jib to accommodate the first rigging arrangement, and a second of the two coaxial pulleys situated in a second position transversely offset from the vertical midplane of the jib to accommodate the second rigging arrangement, a change from the first rigging arrangement to the second rigging arrangement being performed by moving the lifting cable from the first pulley to the second pulley, and an attachment point for attaching an end of the lifting cable to the jib tip in the second rigging arrangement, the attachment point situated on the jib tip on an opposite side of the vertical midplane of the jib with respect to the second position of the pulley; and a lifting block, comprising:

a housing which houses a pulley on a horizontal axis to accommodate the second rigging arrangement, and an attachment point for attaching the end of the lifting cable to the lifting block, and a guide guiding the lifting cable toward the center of the upper part of the housing of the block to accommodate the first rigging arrangement.

7. The device for changing according to claim 1, further comprising a fixing device for temporarily fixing the lifting block under the jib tip, usable during operations of changing the rigging of the blocks between the first rigging arrangement and the second rigging arrangement.

8. The device for changing rigging according to claim 7, wherein fixing device is at least one of a single lug and a double lug secured to the framework of the jib tip and pointing downward, the at least one lug having at least one opening at its lower part in order that a removable axle can be inserted for connection with the upper part of the housing of the lifting block when the lifting block is raised into a high position.

9. The device for changing rigging according to claim 1, the guide on the lifting block further comprising:

a curved guide member borne by an arm mounted to pivot in the housing of the block, the guide member being moveable between at least a raised position substantially tangential to the pulley of the block and guiding the cable toward the center of the upper part of the housing of the block when the block is rigged in the first rigging arrangement, and a retracted lowered position when the block is rigged in the second rigging arrangement; and an immobilizing device for non-permanent immobilization of the guide in at least one of the raised and retracted positions.

10. The device for changing rigging according to claim 9, wherein the curved guide member has a groove tailored to the thickness of the lifting cable.

11. The device for changing the rigging according to claim 9, the lifting block further comprising a stationary mating shape in the upper part of the lifting block facing the raised position of the curved guide member so that the lifting cable passes between the curved guide member and the mating shape when the block is rigged in the first rigging arrangement.

12. The device for changing rigging according to claim 1, the guide on the lifting block further comprising:

a shoe sitting inside the housing of the lifting block, above the pulley of the block, the shoe having a curved side guiding the cable, placed on this side, toward the center of the upper part of the housing of the block; and a fixing device for non-permanent fixing of the shoe in the housing of the block.

13. The device for changing rigging according to claim 1, the housing of the lifting block further comprising legs on the lower part of the housing so that the housing can be set down on the ground.

* * * * *